US009374650B2

(12) United States Patent
Bauman

(10) Patent No.: US 9,374,650 B2
(45) Date of Patent: Jun. 21, 2016

(54) SYSTEM AND METHOD FOR EMBEDDING CONDUCTIVE TRACES INTO HEARING ASSISTANCE DEVICE HOUSINGS

(71) Applicant: Starkey Laboratories, Inc., Eden Prairie, MN (US)

(72) Inventor: Brent Bauman, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 13 days.

(21) Appl. No.: 13/946,675

(22) Filed: Jul. 19, 2013

(65) Prior Publication Data

US 2015/0023539 A1 Jan. 22, 2015

(51) Int. Cl.
*H04R 25/00* (2006.01)
*H04R 31/00* (2006.01)

(52) U.S. Cl.
CPC ..... *H04R 25/658* (2013.01); *H04R 25/554* (2013.01); *H04R 31/00* (2013.01); *H04R 2225/51* (2013.01); *Y10T 29/49018* (2015.01); *Y10T 29/49572* (2015.01)

(58) Field of Classification Search
CPC ..... H01L 24/26; H01L 24/83; H01L 31/18; H01L 41/0536; H01L 41/23; H01L 41/257; H01L 51/52; H01L 51/56; H04R 25/652; H04R 31/00; H05K 13/00; H05K 1/0298; H05K 1/183; H05K 3/0085
USPC ..... 381/322–324, 87; 181/126, 128, 129, 181/130, 135; 29/594, 592, 428, 402.01, 29/407.01, 460, 592.1, 729, 846, 896.1
See application file for complete search history.

(56) References Cited

U.S. PATENT DOCUMENTS

| | | | | |
|---|---|---|---|---|
| 7,260,233 | B2 | 8/2007 | Svendsen et al. | |
| 7,791,551 | B2 * | 9/2010 | Platz | H01Q 1/085 343/718 |
| 8,224,004 | B2 | 7/2012 | Baechler et al. | |
| 8,254,608 | B2 | 8/2012 | De Finis | |
| 2003/0045283 | A1 | 3/2003 | Hagedoorn | |

(Continued)

FOREIGN PATENT DOCUMENTS

| | | | |
|---|---|---|---|
| EP | 1681903 | A2 | 7/2006 |
| EP | 2765650 | A1 | 8/2014 |

(Continued)

OTHER PUBLICATIONS

"3D Circuits -A- Laser",2012, http://www.a-laser.com/3dcircuits.html.*

(Continued)

*Primary Examiner* — Sunita Joshi
(74) *Attorney, Agent, or Firm* — Schwegman Lundberg & Woessner, P.A.

(57) ABSTRACT

Disclosed herein, among other things, are systems and methods for embedding a conductive trace for a hearing assistance device housing. One aspect of the present subject matter includes a method of forming a hearing assistance device housing. The housing is constructed of plastic including a photo conductive dopant, in various embodiments. According to various embodiments, the housing is laser printed to activate the photo conductive dopant on the surface of the plastic to provide a conductive trace on a surface of the housing. The housing is plated using an electroless process to increase the conductivity of the conductive trace, in various embodiments.

22 Claims, 3 Drawing Sheets

(56) References Cited

U.S. PATENT DOCUMENTS

| | | | | |
|---|---|---|---|---|
| 2005/0099341 | A1 | 5/2005 | Zhang et al. | |
| 2005/0244024 | A1 | 11/2005 | Fischer et al. | |
| 2006/0274747 | A1 | 12/2006 | Duchscher et al. | |
| 2007/0080889 | A1 | 4/2007 | Zhang | |
| 2008/0158432 | A1 | 7/2008 | Hwang et al. | |
| 2008/0186241 | A1 | 8/2008 | Christensen | |
| 2008/0272980 | A1 | 11/2008 | Adel et al. | |
| 2009/0173443 | A1 | 7/2009 | Kozlak et al. | |
| 2010/0239111 | A1* | 9/2010 | Karamuk et al. | 381/322 |
| 2010/0304065 | A1* | 12/2010 | Tomantschger | B32B 15/08 428/35.8 |
| 2011/0019830 | A1 | 1/2011 | Leibman et al. | |
| 2011/0051965 | A1 | 3/2011 | Beck et al. | |
| 2012/0093324 | A1 | 4/2012 | Sinasi | |
| 2012/0163644 | A1 | 6/2012 | Xu et al. | |
| 2012/0209101 | A1* | 8/2012 | Kidmose et al. | 600/379 |
| 2013/0017786 | A1 | 1/2013 | Kvist et al. | |
| 2013/0308805 | A1 | 11/2013 | Sinasi | |
| 2014/0023216 | A1 | 1/2014 | Solum et al. | |

FOREIGN PATENT DOCUMENTS

| | | | |
|---|---|---|---|
| JP | 201490467 | A | 5/2014 |
| WO | WO-2006133158 | A1 | 12/2006 |

OTHER PUBLICATIONS

"U.S. Appl. No. 13/551,215, Non Final Office Action mailed Apr. 24, 2014", 16 pgs.

"U.S. Appl. No. 13/551,215, Final Office Action mailed Dec. 3, 2014", 16 pgs.

"U.S. Appl. No. 13/551,215, filed Feb. 3, 2015 to Final Office Action mailed Dec. 3, 2014", 8 pgs.

"U.S. Appl. No. 13/551,215, filed Aug. 19, 2014 to Non Final Office Action mailed Apr. 24, 2014", 9 pgs.

"European Application Serial No. 14177405.9, Extended European Search Report mailed Jan. 5, 2015", 7 pgs.

"U.S. Appl. No. 13/551,215, Advisory Action mailed Apr. 10, 2015", 4 pgs.

"U.S. Appl. No. 13/551,215, Non Final Office Action mailed Sep. 25, 2015", 23 pgs.

"European Application Serial No. 14177405.9, Extended European Search Report Response filed Jul. 28, 2015 to mailed Jan. 5, 2015", (Jul. 28, 2015), 14 pgs.

* cited by examiner

SYSTEM AND METHOD FOR EMBEDDING CONDUCTIVE TRACES INTO HEARING ASSISTANCE DEVICE HOUSINGS

CROSS-REFERENCE TO RELATED APPLICATIONS

This application is related to U.S. patent application Ser. No. 13/551,215, filed Jul. 17, 2012, entitled "HEARING ASSISTANCE DEVICE WITH WIRELESS COMMUNICATION FOR ON-AND OFF-BODY ACCESSORIES," which is hereby incorporated by reference in its entirety.

TECHNICAL FIELD

This document relates generally to hearing assistance systems and more particularly to methods and apparatus for embedded conductive traces for hearing assistance device housings.

BACKGROUND

Modern hearing assistance devices, such as hearing aids, are electronic instruments worn in or around the ear that compensate for hearing losses of hearing-impaired people by specially amplifying sounds. The sounds may be detected from a patient's environment using a microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. The hearing aids may each include an antenna for the wireless communication.

Due to the low power requirements of modern hearing instruments, the system has a minimum amount of power allocated to maintain reliable wireless communication links. Also the small size of modern hearing instruments requires unique solutions to the problem of housing an antenna for the wireless links. The better the antenna, the lower the power consumption of both the transmitter and receiver for a given link performance. Antennas are more efficient when they contain more volume or surface area.

Accordingly, there is a need in the art for improved systems and methods for embedding conductive traces for a hearing assistance device housing.

SUMMARY

Disclosed herein, among other things, are systems and methods for embedding a conductive trace for a hearing assistance device housing. One aspect of the present subject matter includes a method of forming a hearing assistance device housing. The housing is constructed of plastic including a photo conductive dopant, in various embodiments. According to various embodiments, the housing is laser printed to activate the photo conductive dopant on the surface of the plastic to provide a conductive trace on a surface of the housing. The housing is plated using an electroless process to increase the conductivity of the conductive trace, in various embodiments.

One aspect of the present subject matter includes hearing assistance device an enclosure including a faceplate and a shell attached to the faceplate, and a conductive trace embedded in the shell. According to various embodiments, the conductive trace is formed by constructing the shell of plastic including a photo conductive dopant, laser printing the shell to activate the photo conductive dopant on the surface of the plastic to provide the conductive trace on an inside surface of the shell, and plating the shell using an electroless process to increase the conductivity of the conductive trace.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
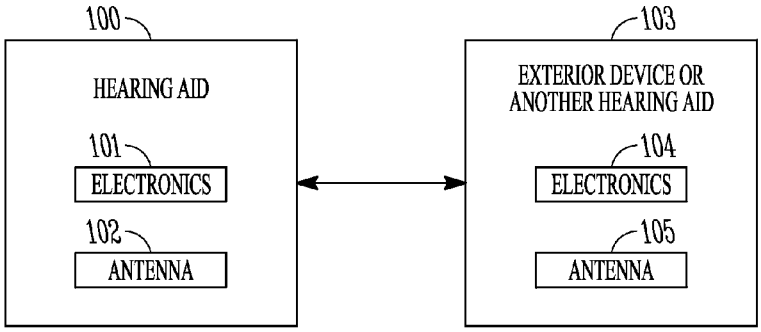
FIGS. 1A and 1B depict embodiments of a hearing assistance device having electronics and an antenna for wireless communication with a device exterior to the hearing assistance device.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Due to the low power requirements of modern hearing instruments, the system has a minimum amount of power allocated to maintain reliable wireless communication links. Also the small size of modern hearing instruments requires unique solutions to the problem of housing an antenna for the wireless links. The better the antenna, the lower the power consumption of both the transmitter and receiver for a given link performance. Antennas are more efficient when they contain more volume or surface area. Therefore, it is desirable to move the antenna closer to the outside of a hearing aid package where the maximum radiating surface area is realized.

Disclosed herein, among other things, are systems and methods for embedding a conductive trace for a hearing assistance device housing. One aspect of the present subject matter includes a method of forming a hearing assistance device housing. The housing is constructed of plastic including a photo conductive dopant, in various embodiments. According to various embodiments, the housing is laser printed to activate the photo conductive dopant on the surface of the plastic to provide a conductive trace on a surface of the housing. The housing is plated using an electroless process to increase the conductivity of the conductive trace, in various embodiments.

The present subject matter provides a consistent method of embedding copper traces into an acrylic shell of a hearing aid. Previously, custom shells were made using a stereolithography (SLA) process with acrylic. Custom hearing aid shells are of different of varying geometries so injection molding is not an option, and shells need to be built from one of several plastic additive methods. One solution is to produce the shell using a fused filament fabrication (FFF) process using a laser direct structuring (LDS) compatible plastic, in an embodiment of the present subject matter. According to various embodiments, once the shell is molded a laser activates the dopant in the plastic along the path traced by the laser, causing the path to become slightly conductive. The path is then electroless plated with copper (or other conductor) to increase the conductivity of the trace, in various embodiments. Thus, the present subject matter provides for placing an antenna on the inside of the shell to provide the maximum aperture size while still maintaining a spacer between the antenna and the user's body.

The present subject matter uses photo activated dopants in plastics, and provides a rapid manufacturing process that does not depend on a consistent static model contrary to the method used in injection molding. Previously, hearing aid shells were made using a SLA process that uses a laser to solidify a liquid resin. However, this poses a problem when trying to use a dopant that is activated by laser light. The present subject matter provides a FFF process that uses small amounts of melted plastic to create 3D structures. The dopant used becomes slightly conductive when photo activated. Various embodiments of the process then provides for melting the plastic to very thin strands and printing it into a shell shape through a nozzle. The photo activated plastic is melted and not activated during the build process, in various embodiments. Once the shell is built and hardened, the shell is processed using a LDS (laser direct structuring) printing process to activate the photo conductive dopant on the surface of the plastic, according to various embodiments. In various embodiments, the shell is then electroless plated with copper to increase the conductivity of the laser etched trace. Thus, the present subject matter provides a process of building custom hearing aid shells and embedding conductive traces that can be used as antennas, circuitry, or RF shielding into the shell.

Figure 3:
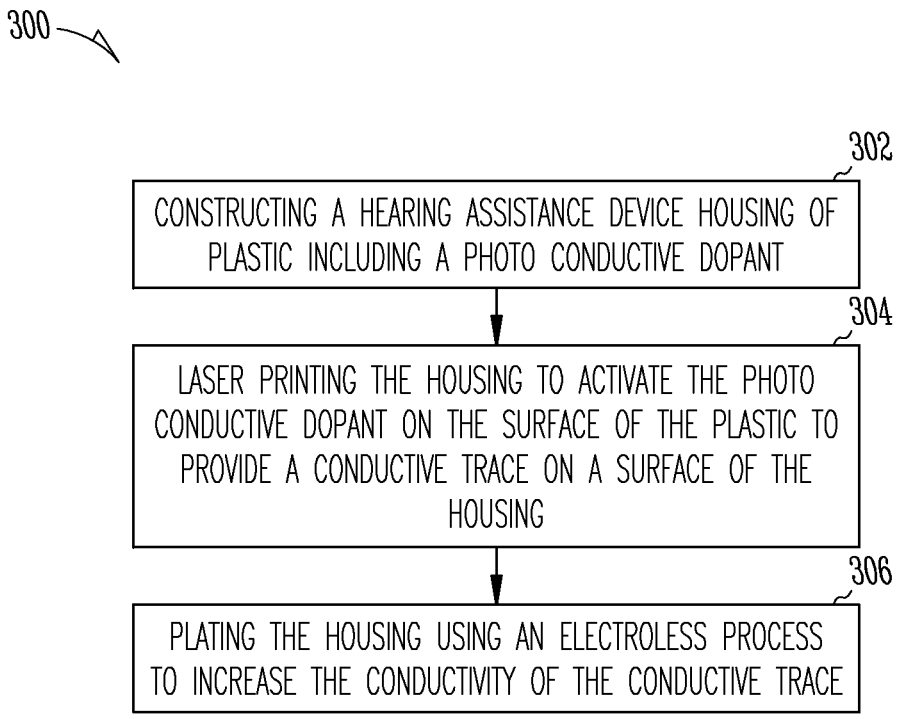
FIG. 3 illustrates a flow diagram of a method for embedding a conductive trace for a hearing assistance device housing, according to various embodiments of the present subject matter.

FIG. 3 illustrates a flow diagram of a method for embedding a conductive trace for a hearing assistance device housing, according to various embodiments of the present subject matter. One aspect of the present subject matter includes a method 300 of forming a hearing assistance device housing. At 302, the housing is constructed of plastic including a photo conductive dopant, in various embodiments. According to various embodiments, the housing is laser printed to activate the photo conductive dopant on the surface of the plastic to provide a conductive trace on a surface of the housing, at 304. At 306, the housing is plated using an electroless process to increase the conductivity of the conductive trace, in various embodiments. The housing is constructed using a fused filament fabrication (FFF) process, in an embodiment. In various embodiments, constructing the housing includes using a photo positive paint to print copper traces on the housing. In one embodiment, a photo activated paint is used that can be laser activated and electroless plated. Providing the conductive trace on a surface of the housing includes providing the conductive trace on an inside or an outside surface of the housing, or both in various embodiments. In an embodiment, providing the conductive trace on a surface of the housing includes providing the conductive trace on an outside surface followed by a high resistive protective layer to minimize body loading and degradation to the antenna material. The conductive trace can be used as an antenna (such as a radio frequency (RF) antenna), a magnetically coupled resonant loop structure, other circuitry such as a hearing assistance circuit, and/or for providing RF shielding in various embodiments.

Additional embodiments can be used without departing form the scope of the present subject matter. For example, photo positive paint can be used to print copper traces on the shells of custom hearing aids. Photo positive paint is electrically inert or has a high resistance until sections are activated by a laser where the portion activated has a low enough resistance to be electrolessly plated. Other methods for plating plastic shells can be used without departing from the scope of the present subject matter. For example, vacuum metallization and electroplating or electroless plating can be used, in an embodiment. The plastic shell can be coated in metal, than a 3D photolithographic (or photo activated coating) can be used, followed by a laser to render the etch protection pattern on the 3D surface. An etching process can then be used to remove the material.

Benefits of the present subject matter include the ability to: rapidly manufacture custom shells with embedded conductive traces; implement larger antennas into custom shells; implement parasitic resonator loops into IIC and other custom shells; eliminate the use of wire, flex, or other added conductor part used for antenna; decrease internal volume needed to contain antenna and therefore provide for smaller package size; provide a more accurate production method with smaller tolerances; and decrease manual assembly and build time of custom parts.

Figure 1B:
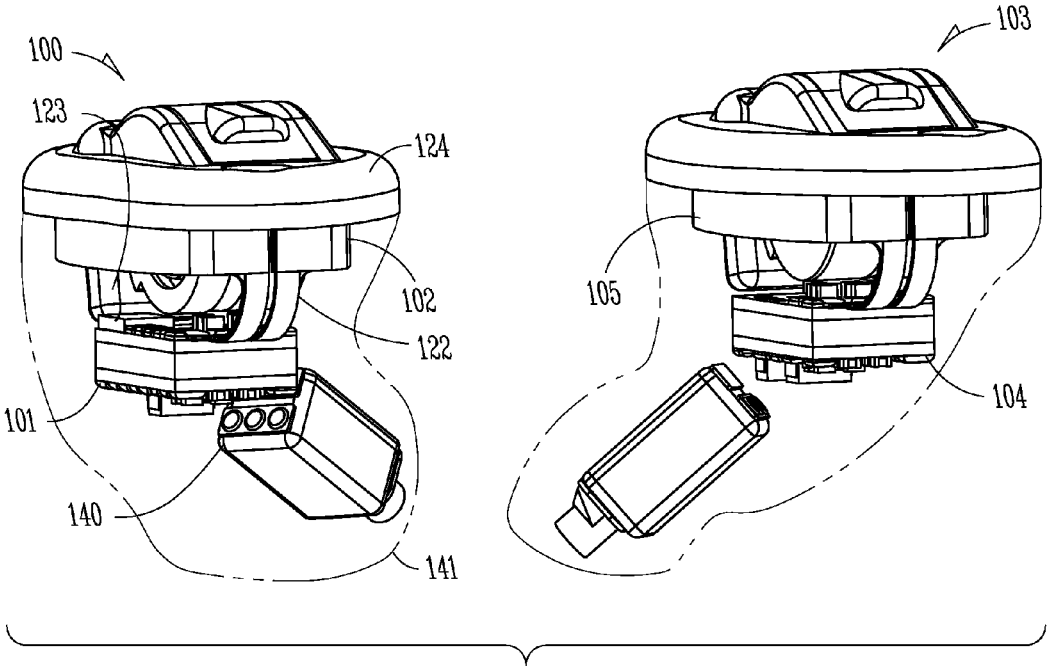

Various embodiments provide for using the embedded conductive traces of the present subject matter as antennas for a hearing assistance device. FIGS. 1A and 1B depict embodiments of a hearing assistance device having electronics and an antenna for wireless communication with a device exterior to the hearing assistance device. FIG. 1A depicts an embodiment of a hearing aid 100 having electronics 101 and an antenna 102 for wireless communication with a device 103 exterior to the hearing aid. The exterior device 103 includes electronics 104 and an antenna 105 for communicating information with hearing aid 100. In an embodiment, the hearing aid 100 includes an antenna embedded in a housing of the hearing aid using a method of the present subject matter. FIG. 1B illustrate two hearing aids 100 and 103 with wireless communication capabilities. In addition to the electronics and antennas, the illustrated hearing aids include a faceplate substrate 124, a battery 122 received in an opening of faceplate substrate through a battery door, a microphone 123, and a receiver 140 within a shell 141 of the hearing aid.

Figure 2:
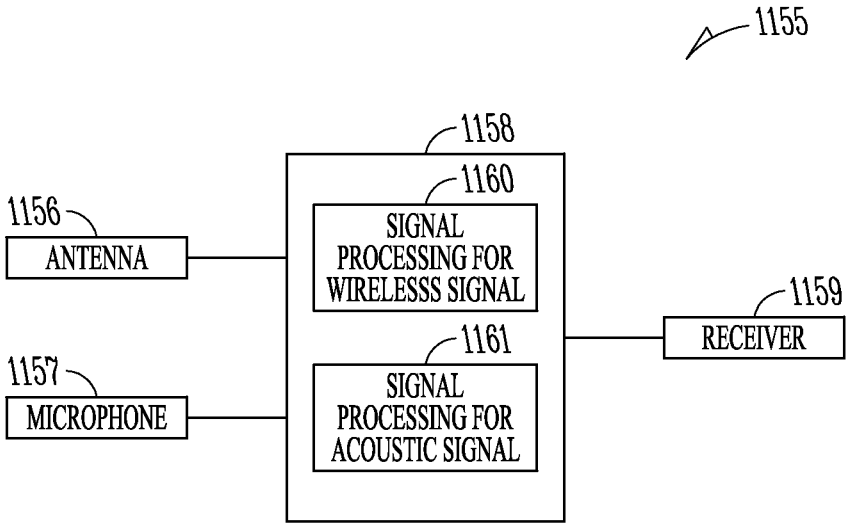
FIG. 2 illustrates a block diagram for a hearing assistance device, according to various embodiments.

FIG. 2 illustrates a block diagram for a hearing assistance device, according to various embodiments. An example of a hearing assistance device is a hearing aid. The illustrated device 1155 includes an antenna 1156 according to various embodiments described herein, a microphone 1157, signal processing electronics 1158, and a receiver 1159. The illustrated signal processing electronics includes signal processing electronics 1160 to process the wireless signal received or transmitted using the antenna. The illustrated signal processing electronics 1158 further include signal processing electronics 1161 to process the acoustic signal received by the microphone. The signal processing electronics 1158 is adapted to present a signal representative of a sound to the receiver (e.g. speaker), which converts the signal into sound for the wearer of the device 1155.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (IIC), receiver-in-canal (RIC), completely-in-the-canal (CIC) or invisible-in-canal (IIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of forming a hearing assistance device housing, comprising:

constructing the housing of laser direct structuring (LDS) compatible plastic including a photo conductive dopant;

laser printing the housing to activate the photo conductive dopant along a path traced by the laser on the surface of the plastic to provide a conductive trace on a surface of the housing; and plating the housing using an electroless process to increase the conductivity of the conductive trace to provide a first conductive portion of the housing along the path traced by the laser for use as a radio frequency antenna and a second conductive portion of the housing to provide radio frequency shielding.

2. The method of claim 1, wherein constructing the housing includes using a fused filament fabrication (FFF) process.

3. The method of claim 1, wherein constructing the housing includes using a photo positive paint to print copper traces on the housing.

4. The method of claim 1, wherein constructing the housing includes using a photo activated paint that is adapted to be laser activated and electroless plated.

5. The method of claim 1, wherein providing the conductive trace on a surface of the housing includes providing the conductive trace on an inside surface of the housing.

6. The method of claim 1, wherein providing the conductive trace on a surface of the housing includes providing the conductive trace on an outside surface of the housing.

7. The method of claim 1, wherein providing the conductive trace on a surface of the housing includes providing the conductive trace on an outside surface followed by a high resistive protective layer to minimize body loading and degradation to the antenna material.

8. The method of claim 1, wherein providing the conductive trace includes providing an antenna.

9. The method of claim 8, wherein providing the antenna includes providing a radio frequency (RF) antenna.

10. The method of claim 1, wherein providing the conductive trace includes providing a magnetically coupled resonant loop structure.

11. The method of claim 1, wherein providing the conductive trace includes providing a hearing assistance circuit.

12. The method of claim 1, wherein providing the conductive trace includes providing RF shielding.

13. A hearing assistance device, comprising:

an enclosure including a faceplate and a shell attached to the faceplate;

a conductive trace embedded in the shell, the conductive trace formed by:

constructing the shell of laser direct structuring (LDS) compatible plastic including a photo conductive dopant;

laser printing the shell to activate the photo conductive dopant along a path traced by the laser on the surface of the plastic to provide the conductive trace on an inside surface of the shell; and plating the shell using an electroless process to increase the conductivity of the conductive trace to provide a first conductive portion of the housing along the path traced by the laser for use as a radio frequency antenna and a second conductive portion of the housing to provide radio frequency shielding.

14. The device of claim 13, wherein the conductive trace includes an antenna.

15. The device of claim 14, wherein the antenna includes a radio frequency (RF, antenna.

16. The device of claim 13, wherein the conductive trace includes a magnetically coupled resonant loop structure.

17. The device of claim 13, wherein the conductive trace includes a hearing assistance circuit.

18. The device of claim 13, wherein the conductive trace includes RF shielding.

19. The device of claim 13, wherein the photo conductive dopant includes a photo positive paint.

20. The device of claim 13, wherein the shell includes a custom in-the-ear (ITE) shell.

21. The device of claim 13, wherein the shell includes a custom completely-in-the-canal (CIC) shell.

22. The device of claim 13, wherein the shell includes a custom invisible-in-canal (IIC) shell.

* * * * *